United States Patent [19]

Lex

[11] 4,357,730

[45] Nov. 9, 1982

[54] PORTABLE CLEANING APPARATUS

[76] Inventor: Franz Lex, Annenstrasse 6, 8020 Graz, Austria

[21] Appl. No.: 129,455

[22] Filed: Mar. 11, 1980

[30] Foreign Application Priority Data

Mar. 13, 1979 [AT] Austria ..... 1898/79

[51] Int. Cl.[3] ..... A47L 5/26

[52] U.S. Cl. ..... 15/344; 15/384; 15/390

[58] Field of Search ..... 15/23, 344, 384, 390

[56] References Cited

U.S. PATENT DOCUMENTS

| | | | |
|---|---|---|---|
| 1,651,585 | 12/1957 | Clair | 15/390 X |
| 2,205,599 | 6/1940 | Mitchell | 15/344 |
| 2,303,089 | 11/1942 | Peterson | 15/384 X |
| 2,941,232 | 6/1960 | Milbourne | 15/384 X |

FOREIGN PATENT DOCUMENTS

| | | | |
|---|---|---|---|
| 738479 | 10/1955 | United Kingdom | 15/344 |

*Primary Examiner*—Chris K. Moore

*Attorney, Agent, or Firm*—Watson, Cole, Grindle & Watson

[57] ABSTRACT

In a portable cleaning apparatus, at least two rotatable cleaning members are mounted within a casing and contra-rotationally driven by an electrical motor and step-down gearing arranged between the motor and the cleaning members with a releasable clutch connecting the driving motor to the cleaning members. A cover is mounted over the rotatable cleaning members and the electrical motor and the casing includes a vent channel communicating with the cover. Suction from the at least two cleaning members to a dust collector, mounted at the end of the vent channel formed as a handhold, is provided by a blower driven by the electrical motor. The axes of the driving motor and the at least two cleaning members are parallel with one another and a blower rotor connected to a shaft of the driving motor is arranged behind an opening out of the cover into the casing as viewed from the direction of air flow.

7 Claims, 5 Drawing Figures

PORTABLE CLEANING APPARATUS

BACKGROUND

1. Field of the Invention

This invention relates to a portable cleaning apparatus, comprising a casing with an electrical driving motor for two cleaning members of at least approximately cylindrical shape, e.g. cleaning brushes, which are driven by a step-down gearing and provided with a cover, and further provided with a suction device.

2. Prior Art

A cleaning apparatus of this kind is described, for example, in U.S. Pat. No. 2,941,252. This apparatus is used for cleaning Venetian blinds and shows a casing with a driving motor supported therein, which is driving two roller brushes lying parallel to each other by means of several bevel gears and the brushes are pivoted at both ends in a part of the casing which is performed as a cover. The directions of rotation of the cleaning brushes are such that the dust is brushed to the outside against the cover. A handhold formed as a vent pipe is arranged parallel to the cover or to the brushes, respectively, which can be connected to a vacuum cleaner.

Contrary to numerous known constructions of similar kind which have just one single cleaning brush, or to apparatus with two brushes arranged one below the other for cleaning two sides of an object, e.g., the slots of a Venetian blind, the arrangement of two brushes in parallel and side-by-side gives the advantage of better cleaning effect and an easier handling of the apparatus as the tangential forces are compensated and the otherwise resulting tiring holding force does not occur.

The above-mentioned and other known arrangements of a cleaning apparatus with rotational driven brushes have the substantial disadvantage, that the brushed-up dust is brushed away tangentially to the outside. To enable an efficient venting of the brushed up dust most of the known apparatus are provided for connection to the suction pipe of a conventional vacuum cleaner. Thereby, a laborious handling and preparation to set the apparatus to work is necessary, which is a further disadvantage.

If the driving motor is used simultaneously to drive a dust suction fan, as, e.g., known from German laid open specification No. 1 428 388, it is necessary because of the reasons mentioned above to ensure a sufficient dust venting, to use a high-power driving motor, in particular for the exhaust of dust, whereby the weight and the over-all dimensions of the apparatus are significantly increased and the handiness of such an apparatus is reduced.

SUMMARY OF THE INVENTION

It is an object of the present invention to develop a cleaning apparatus of the kind mentioned above in such a way, that a simple and easy handling is guaranteed and that an efficient exhaust of dust can be obtained even with a low-power drive.

According to the invention this is obtained if the two cleaning members, the rotary motion of which is directed to the inside in the region of their working range, are provided partly with a cover, which is opening out into a vent channel provided in the casing and connected to the suction side of a blower and to a dust collector.

Thus, the dust and dirt of the subject to be cleaned is brushed to the inside and directly into the vent channel, whereby a suitable exhaust of dust is obtainable even with a less-powered blower. The dimensions and the weight of the apparatus can be kept low and the troublesome connection to a vacuum cleaner is no longer necessary.

It is practical to arrange the taper bore of the cleaning member mounted and projecting from the casing at the lower rim as well as in longitudinal direction to ensure easy replaceability and good accessibility.

According to a further development of the invention, the cover partly surrounding the cleaning members is connected to the casing and a suction nozzle or something similar is provided, which can be attached instead of the cover or at the latter. As the cleaning apparatus can be used for many purposes also as a vacuum cleaner it is further advantageous if, according to another embodiment of the invention, only one driving motor is provided for driving the cleaning members and the blower and a step-down gearing is arranged between the driving motor and cleaning members.

For many purposes it is further advantageous if the step-down gearing for the cleaning members and/or the blower rotor are connectable to the shaft of the driving motor by means of a releasable clutch. Thus, the step-down gearing does not function if the cleaning members are out of use, whereby not only the noise caused by the cleaning apparatus, but also the power consumption is reduced. For example, switching off the blower is advantageous if the apparatus is used to polish, as an exhaust is not necessary in that case.

An especially advantageous development of the invention is obtained if the axes of the driving motor and the cleaning members are square with each other, and the blower rotor connected to the shaft of the driving motor is arranged, seen in the direction of flow, behind the opening out of the cover into the casing and between the driving motor and the stepdown gearing, and if the dust collector is arranged at the end of an adjacent dust vent channel which is preferably performed as a handhold. Accordingly, a cleaning apparatus with an efficient exhaust and brushing effect is obtained, which has small dimensions, low weight and good accessibility. Furthermore, the volume of the dust collector can be varied according to the actual purpose; it is possible, e.g., if using the apparatus as a shoe cleaning apparatus, to arrange the dust collector in the handhold and if the apparatus is used to clean upholstered furniture to arrange the dust collector, formed as a dustbag, at the outside.

An especially improved handling and a balanced weight distribution of the apparatus is obtained, according to a further embodiment of the invention by providing that the axes of the driving motor and the cleaning members are parallel with each other and that the blower rotor connected to the shaft of the driving motor, seen in the direction of flow, is arranged behind the opening out of the cover into the casing, the step-down gearing is arranged adjacent the blower rotor on the side of the driving motor, and the dust collector is arranged at the end of a vent channel formed as a handhold.

An especially useful and handy embodiment which results in a good ventilation is obtained in a further embodiment of the invention, wherein the axes of the driving motor and the cleaning members are parallel with each other and the blower rotor connected to the shaft of the driving motor is pivoted on the side opposite the step-down gearing and the dust collector is arranged before the blower rotor. Thus the dust is exhausted via the vent channel formed as a handhold into the dust collector and the air cleaned therein is guided to the outside via venting slots in the casing.

The various embodiments of the apparatus according to this invention enable not only the brushing and vacuum cleaning of objects to be cleaned but also the cleaning and polishing of objects without exhausting the dust. For the cleaning of especially soiled objects or for polishing it is practical to use a liquid or foamy cleansing or polishing agent. Several unhandy arrangements especially made for this purpose are known for the cleaning of floors, which are provided with a container for liquid or foamy agent. It is also possible to apply a container for a liquid or foamy agent to lead to the cleaning members. It is also possible to replace the dust collector in the container for the cleaning or polishing agent.

Therefore, the present invention provides apparatus combining the advantages of many of the known embodiments, even of heavy non-portable ones, induces widespread new applications, especially for all the "at times" cleaning processes, and which is easy to handle because of its low weight and small dimensions.

BRIEF DESCRIPTION OF THE DRAWINGS

The invention is more specifically described with reference to three exemplary embodiments.

DETAILED DESCRIPTION

Figure 1:
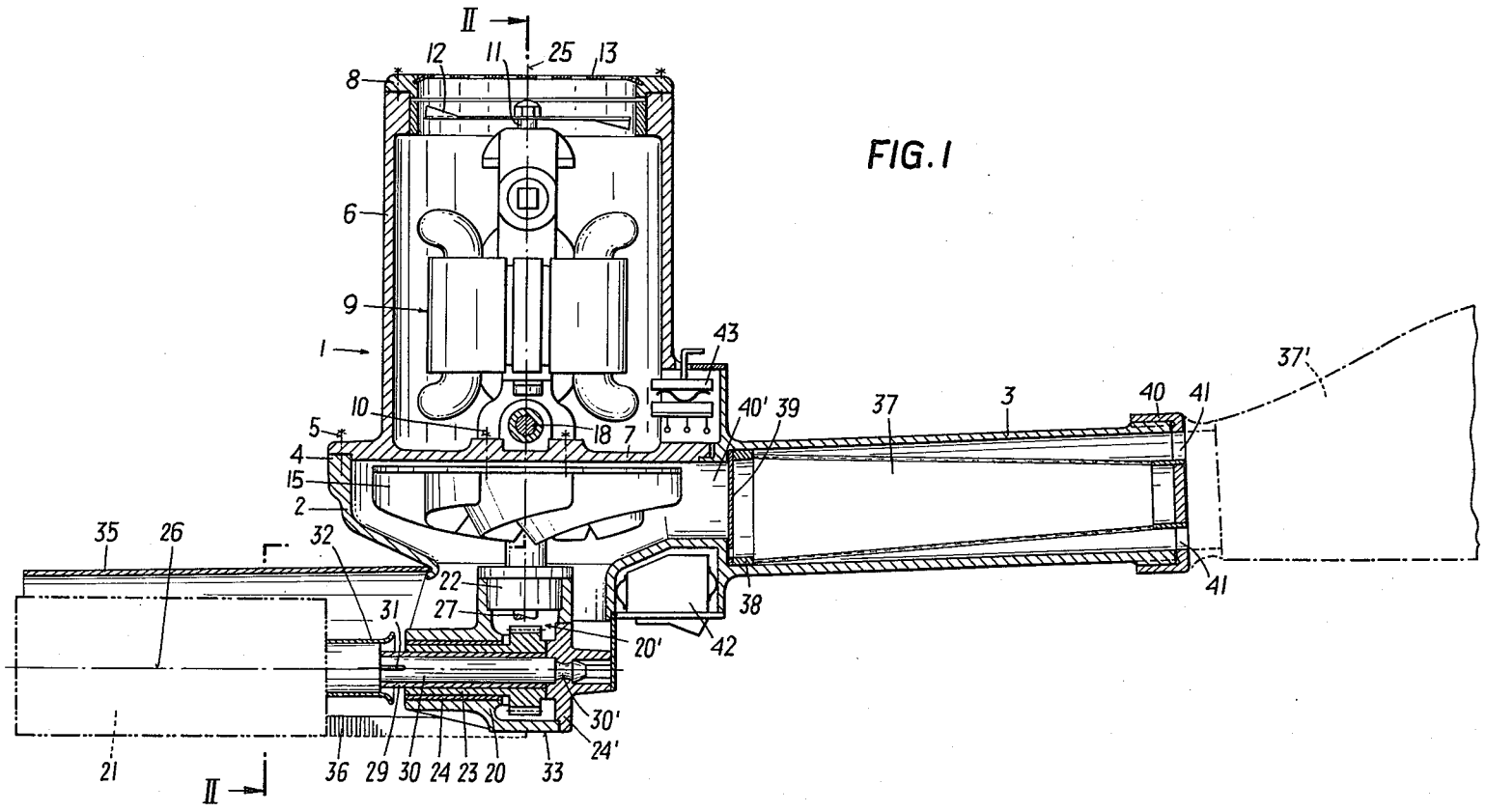
FIG. 1 shows a longitudinal sectional view of a cleaning apparatus according to this invention, FIG. 2 a cross sectional view taken along line II—II in FIG. 1, FIG. 3 a longitudinal sectional view of another cleaning apparatus according to this invention, FIG. 4 a view along arrow IV in FIG. 3, and FIG. 5 a longitudinal sectional view of a further embodiment.
Figure 2:
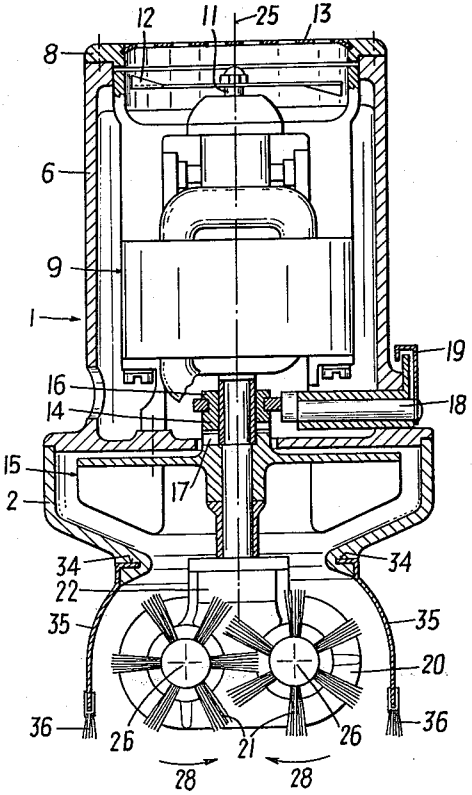

The embodiment depicted in FIGS. 1 and 2 is a portable cleaning apparatus according to the invention, which can be used as a brushing and vacuum cleaning apparatus. The casing 1 shows a lower part 2 with a handhold 3 in one piece with the same and an upper part 6 which is screwable to a flange 4 at the lower part 2 by means of screws, indicated by their axes of symmetry 5. The upper part 6 is formed cylindrically and shows at the end adjacent the lower part 2 a front plate 7 formed in one piece with the cylindrical part and at the opposite end a cap 8 fixed by screws. The driving motor 9 can be inserted into the cylindrical upper part 6 via the opening covered up by the cap 8, and can be fixed to the front plate 7 by means of screws, indicated by their lines of symmetry 10. A little fan rotor 12 is fixed to the rear end of the shaft 11 of the driving motor 9 and acts to cool the driving motor. The cooling air can pass off via a lattice 13 provided in the cover 8.

The lower part 2 of the casing 1 forms a distributor for a rotor 15 of a radial-flow blower, which is connected to the shaft of the driving motor 9 by a releasable clutch 14. The rotor 15 is rotatable at the lower smooth part of the shaft 11 of the driving motor 9. Near the driving motor 9 the shaft 11 has longitudinal grooves along which a sleeve 16 of a gear coupling 14 is axially movable but transmitting the driving motor torque. The rotor 15 has at its hub gear 17 adjacent the driving motor 9, which meshes with corresponding gears at the sleeve 16, whereby the torque transmission from the shaft 11 of the driving motor 9 to the rotor 15 is established. The sleeve 16 can be axially moved to the driving motor by means of an eccentric lever 18 supported at the upper part 6 of the casing, whereby it is brought out of engagement with the rotor 15. The eccentric lever 18 can be secured in its position by a safety stirrup 19.

A gear case 20 is formed in one piece with the lower part 2 of the casing 1, and supports a worm gear 20' to reduce the rotational speed of the driving motor and to drive the cleaning members 21, which are projecting in the direction of their axes over the casing 1. At the entry of the driving shaft 11 into the gear case 20 a step bearing 22' is arranged, which can also include a slipper clutch 22. Two driving bushings 23 are formed in one piece each including one worm wheel and rotated parallel to each other in very long sleeve bearings 24 in the gear case 20 in such a way, that the axis 25 of the shaft 11 of the driving motor 9 lies at right angle to the axes 26 of the cleaning members 21. Both driving bushings 23 are driven by a worm spindle 27 protruding from the step bearing 22', whereby the cleaning members 21 are contra-rotating. The direction of rotation of the driving motor 9 is chosen so that the cleaning members 21 contra-rotate in the directions indicated by arrows 28 in FIG. 2.

Each driving bushings 23 includes a receiving jacket 29 connected thereto, which receives the axis 30 of the cleaning member 21. The receiving jackets 29 each show at least one longitudinal slot 31 at the end adjacent to the cleaning member 21 into which engaging pieces provided at the axes 30 mesh when the cleaning members 21 are inserted into the receiving jackets 29. The ends of the axes 30 are provided with annular grooves 30' which engage with projections at bearing caps 24' and are thereby axially secured. The cleaning members 21 include deflection jackets 32 pressed on to their axes 30 at the side adjacent the gear case 20 which are protecting the sleeve bearings 24 or the gearing, respectively, against pollution, by deflecting the dusty air stream created by the blower rotor 15.

The cleaning members 21 are taper-bore-mounted in the casing 1 via the sleeve bearings 24 and extend away along their whole length from the casing 1 in the axial direction. The diameter of the cleaning members 21 is chosen so as to project over the lower rim 33 of the casing 1 of the cleaning apparatus.

The lower part 2 has grooves 34 at the outer side thereof in the region of the opening for the air entry to the rotor 15, into which a removable cover 35 can be plugged in. The cover 35 extends over the whole length of the working surface of the cleaning members 21 and at the sides down to approximately the level of the lower rim 33 of the casing 1, which provides a suction inlet in communication with inlet 40'. To achieve good exhaust by the blower, sealing brush profiles 36 are attached to the side rims of the cover 35.

A hollow handhold 3 is formed in one piece with the lower part 2 of the casing 1 at the side opposite the cover 35 and extends in the direction of the axes 26 of the cleaning members 21. A dust bag 37 is inserted into the handhold 3 which has a thrust ring 38 at the front end thereof, by which the dust bag is centered inside the handhold 3. A nonreturn flap 39 is arranged just in front of the thrust ring 38, which opens into the dust bag 37 and prevents the discharging of the dust bag into the blower space or inlet 40'. The dust bag 37 is fixed at its rear end to a cap 40, which shows openings 41 for outletting the exhausted air. Thereby, it is possible to remove the cap 40 together with the dust bag 37 by simply turning the cap 40 which is fastened to the handhold 3 by means of a slide lock. If very much dust is to collect it is possible to use instead of the dust bag 37 a bigger dust bag 37' connected to the cap 40 as indicated by the dash-dotted line in FIG. 1.

The main switch 42 is insertably arranged in a clearance in the lower part 2 near the beginning of the handhold 3 and can therefore be reached easily by the forefinger of the operator. On the opposite side of the casing 1 a sequence switch 43 is provided at the upper part 6, by which the rotational speed of the driving motor 9 or the cleaning members 21, respectively, can be varied.

Figure 4:
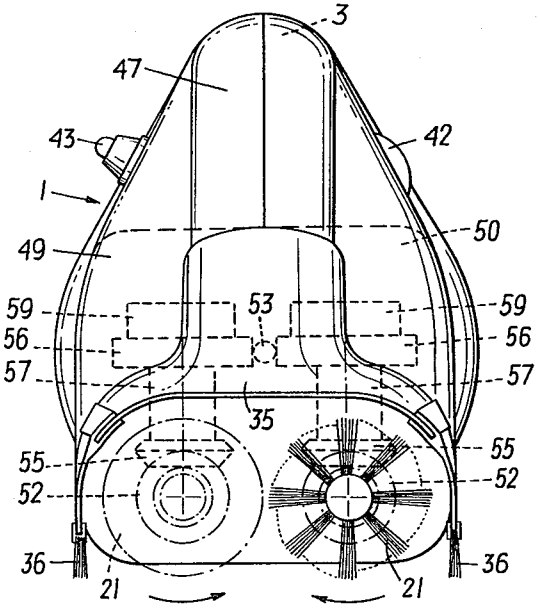
Figure 3:
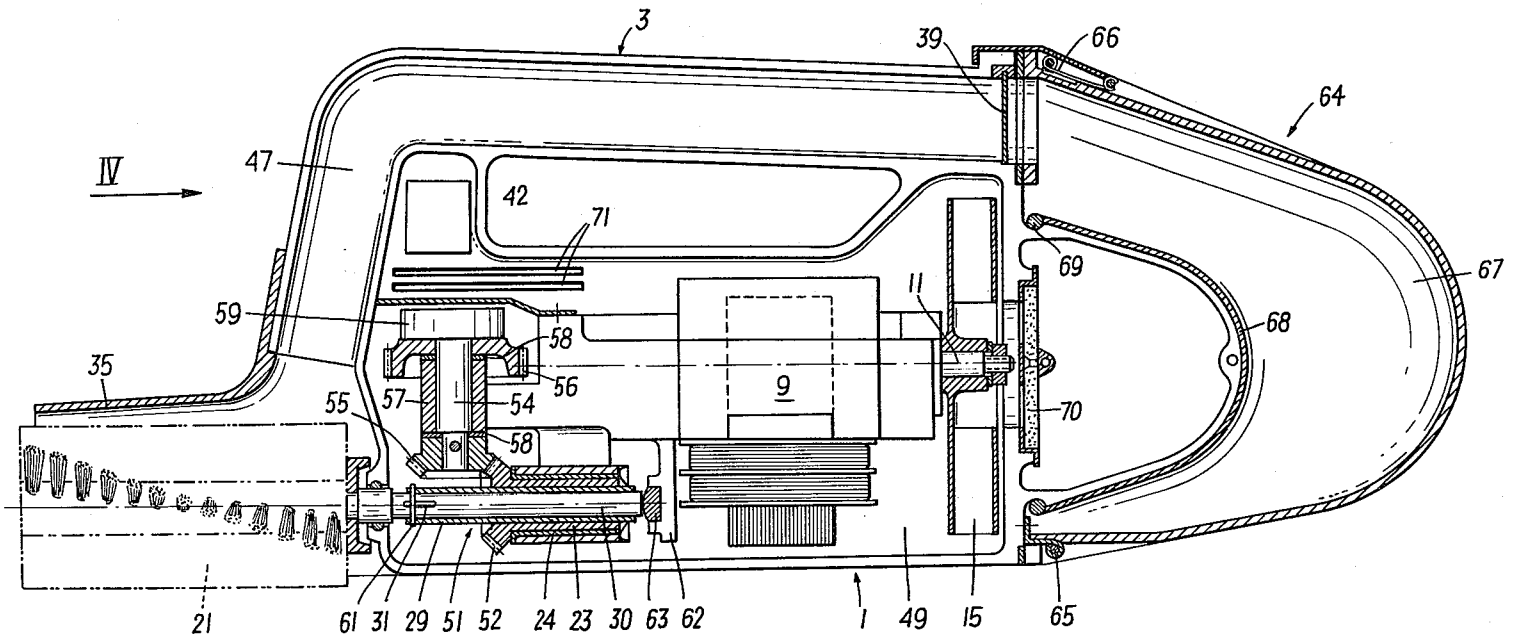

The FIGS. 3 and 4 show a further embodiment of the cleaning apparatus according to this invention. The casing 1 is separated axially in longitudinal direction and the two casing parts 49, 50 are joined together by bolts or clamps, not shown. The driving motor 9 has a shaft 11 arranged in longitudinal direction in the casing 1, and the cleaning members 21 are parallel to each other and driven by a bevel gearing 51. The driving bushing 23 each have a bevel gear 52 and are pivoted parallel to the driving shaft 11 in long sleeve bearings 24, which are provided on extensions on the driving motor 9. The driving connection between bushing 23 and the worm gear 53 on the front end of the driving shaft 11 is done by a shaft 54 for each bushing 23. The shaft 54 lies perpendicular to bushing 23 and shows at its lower end a driving bevel gear 55 which is connected to the lower end of the shaft 54 and in gear with the bevel gear 52 and at its upper end a worm gear 56 which is in gear with the worm gear 53. The driving shaft 54 is pivoted in a bearing 57 provided in the casing, and metal rings 58 are arranged between the bearings 57 and the rotating worm gear 56 or the bevel gear 55, respectively, to reduce fraying. A slip clutch 59 is arranged at the upper end of the driving shaft 54, whereby an overload of the driving motor 9 can be prevented.

Again receiving jackets 29 are provided in the driving bushings 23, which receive the axes 30 of the cleaning members 21. The receiving jackets 29 include longitudinal slots 31 at their front ends into which engaging pieces provided at the axes 30 mesh. The cleaning members 21 are secured in their position by annular springs 61 which are arranged at the front ends of the receiving jackets and squeeze them. To change or remove the cleaning members 21 a cotter pin 63 is transverse to the axes 30 on the rear ends thereof, which is movable in a groove provided in an extension 62 of the driving motor 9. By tightening the cotter pin 63 the cleaning members 21 are pressed out of the receiving jackets 29 against the holding force of the annular springs 61. A blower rotor 15 is attached to the rear end of the shaft 11 of the driving motor 9 to enable the use of this embodiment as a vacuum cleaner or also as a "brushing vacuum cleaner".

A vent channel 47 runs along the upper side of the apparatus, which is formed as a handhold 3, and opens out into a suction inlet formed by casing 1 and the cover 35 for the cleaning members 21. A dust collector 64 is provided at the back side of the casing 1, into which the vent channel 47 opens out. A check valve 39 is arranged at the entrance to the dust collector. The dust collector comprises a dust container 67, which is hinged at the rear side of the apparatus by means of hinges 65 and fixed by a block 66, and a dust bag 68, which has a rubber or spring ring 69 sewed or otherwise fastened therein, by means of which it is fixed but easily removable from the casing 1 which is formed cone-like at its end. A dust filter 70 is additionally arranged at the casing 1 just before the entrance to the rotor 15. Therefore, the dust brushed up by the cleaning members 21 is conveyed by the rotor 15 at the rear end of the driving motor via the vent channel 47 formed as a handhold to the dust collector 64 and is deposited at the dust bag 68. The air passes the dust bag 68, reaches the inside of the casing 1 via the dust filter 70, cools the driving motor 9 and finally leaves the casing 1 via slots 71 provided at the side walls thereof. Thereby, a very effective cooling of the driving motor is enabled, and a soiling of the motor 9 and the gearing 51 is advantageously prevented by the provision of the dust filter 70.

In the front region of the handhold 3, easily to reach by the thumb or the forefinger of the operator, the main switch 42 is inserted in the casing, which is formed as a revolving switch and enables the infinitely variable speed control of the cleaning members 21. The outgoing cable is indicated by 43. Obviously, it is possible also in this embodiment to remove the cleaning members 21, replace the cover 35 by a suction nozzle, and use the cleaning apparatus as a vacuum cleaner. Further, the driving motor 9, the blower rotor 15 fixed to the shaft 11, the bevel gearing 51 and the slip clutch 59 are built as an assembly, which is inserted into the casing 1 and fixed by bolts or clamps, which are also connecting the two parts 49 and 50 of the casing.

Figure 5:
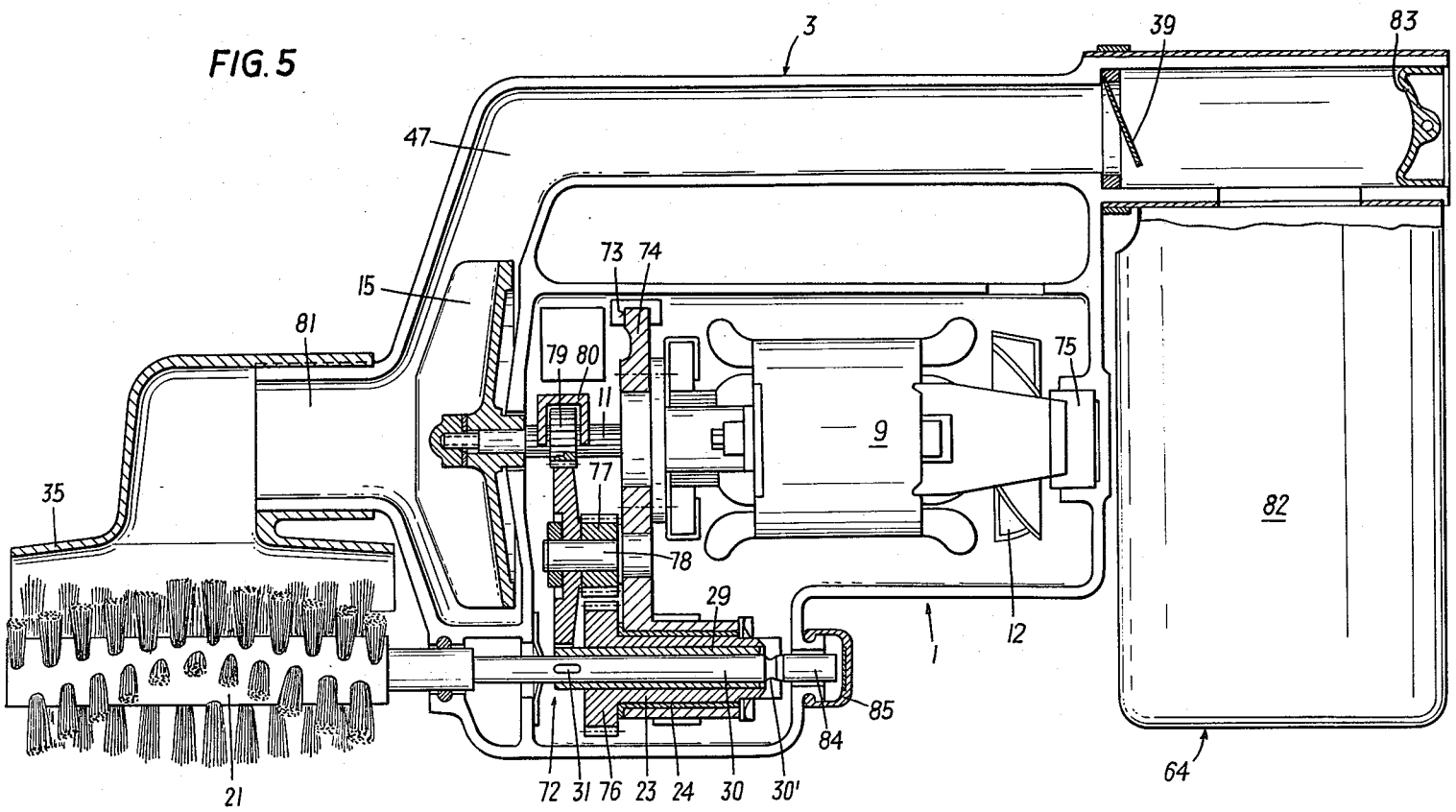

The embodiment depicted in FIG. 5 is similar to the one of FIG. 3; however, the cleaning members 21 lying parallel to the shaft 11 of the driving motor 9 are driven via a right spur gearing 72. The casing 1 is separated longitudinally into two parts along a vertical plane. The driving motor 9, the right spur gearing 72, and the sleeve bearings 24 for receiving the driving bushing 23 for the two parallel cleaning members 21, together are fixed to a carrier plate 73. The carrier plate 73 can be inserted into grooves 74 in the casing 1, whereby the whole driving unit is supported in the casing 1 via the carrier plate 73 and the bearing 75 at the rear end of the shaft 11 of the driving motor 9. The driving connection between the shaft 11 of the driving motor 9 and the spur gear 76 on the driving bush 23 is established via spur gears 77 which are rotated on shaft 78 which is inserted in the carrier plate 73. The front end of the shaft 11 of the driving motor 9 has longitudinal grooves, whereby the driving gear 79 arranged thereon is axially movable via the lever 80 and can be brought out of meshing relationship with the spur gears 77.

The shaft 11 penetrates the casing 1 just in front of the driving gear 79 and extends with its end into the vent channel 47, which is integral with the casing 1 and partly formed as a handhold 3. A blower rotor 15 is fixed to the end of the shaft 11 in the vent channel 47, which acts together with the surrounding walls of the casing as a radial-flow blower for the dust exhaust. The casing includes a connecting socket 81 at the entrance to the blower, which is arranged concentrically with the shaft 11 of the driving motor or the rotor 15, respectively. Several different covers 35 can be attached to the socket 81.

The rotor 15 sucks in the dust brushed up by the cleaning members 21 through a suction inlet formed by casing 1 and communicating with an inlet in the vent channel in the region of connecting socket 81 and delivers it via the vent channel 47 into the dust collector 64 at the rear end of the cleaning apparatus. The dust collector 64 essentially consists of a dust bag 82 of cloth like material penetrable by air. A nonreturn flap 39 is provided at the entrance of the vent channel 47 into the dust collector 64. The vent channel 47 is covered up at its rear end by a removable lid 83. If the lid 83 is removed a lengthening rod can be inserted into the opening, whereby the cleaning apparatus can also be used as a "stem-apparatus". The driving motor is cooled by a fan 12 on the rear end of the shaft 11.

The cleaning members 21 can be inserted, as already described with the other embodiments, into receiving jackets 29, which have longitudinal slots 31 at their front ends. Engaging pieces provided at the axes 30 mesh with the slots 31, whereby the driving motor torque is transmitted via the driving bushings 23, and the receiving jackets 29. The rear ends of the axes 30 of the cleaning members 21 extend through an extension of the casing and are covered by caps 85. The axle boxes are slotted at the ends thereof and include projections, which mesh with an annular groove 30' on the axes 30 and secure the cleaning members 21 axially. To change the cleaning members, the axes 30 are brought out of engagement with the longitudinal slots 31 of the receiving jackets 29 by pressing the caps 85.

The cleaning members 21 used with the described cleaning apparatus can be performed in many different ways. Besides a cylindrical brush having bristles along the circumference and length thereof, it is possible to use cleaning or polishing members made of fur, felt, foam, plastic or metal braid as well as wire brushes. According to the field of application, the cleaning members can show a shape different than a cylindrical shape, e.g., dished to the outside or to the inside. Furthermore, it is possible to vary the distance of the cleaning members; for example to let the cleaning members touch each other at the outer circumference (FIG. 4) or to let the bristles engage each other (FIG. 2).

That which is claimed is:

1. Portable cleaning apparatus, comprising:

a casing;

at least two rotatable cleaning members at least partially mounted within said casing;

an electrical driving motor and step-down gearing for rotating said at least two cleaning members;

said casing forming a suction inlet therein;

a removable cover mounted on said suction inlet and partially covering said at least two cleaning members;

a vent channel formed within said casing and having an inlet communicating with said suction inlet;

a blower driven by said electrical driving motor and providing suction from said at least two cleaing members into said suction inlet and to a dust collector;

and said at least two cleaning members being rotated in opposite directions to direct dust between said at least two rotatable cleaning members and towards said suction inlet.

2. Cleaning apparatus according to claim 1, further comprising a suction nozzle adapted to be attached to said cover.

3. Cleaning apparatus according to claim 1, wherein said step-down gearing is arranged between said driving motor and said at least two cleaning members.

4. Cleaning apparatus according to claim 3, further comprising a releasable clutch for connecting said driving motor to said at least two cleaning members.

5. Cleaning apparatus according to claim 3 or 4, wherein the axes of said driving motor and said at least two cleaning members are perpendicular to each other, and the blower rotor connected to the shaft of the driving motor is arranged, as seen in the direction of air flow, behind said suction inlet into said casing and between the driving motor and the step-down gearing, and said dust collector is arranged at the end of an adjacent dust vent channel which is preferably formed as a handhold.

6. Cleaning apparatus according to claim 3 or 4, wherein the axes of the driving motor and said at least two cleaning members are parallel with each other and the blower rotor connected to the shaft of the driving motor is arranged, as seen in the direction of air flow, behind said suction inlet, said step-down gearing is arranged adjacent the blower rotor on the side of the driving motor, and said dust collector is arranged at the end of said vent channel formed as a handhold.

7. Cleaning apparatus according to claim 3 or 4, wherein the axes of the driving motor and said at least two cleaning members are parallel with each other and the blower rotor connected to the shaft of the driving motor is pivoted on the side opposite said step-down gearing, and said dust collector is arranged before the blower rotor.

* * * * *